US009085864B2

(12) United States Patent
Ortiz

(10) Patent No.: US 9,085,864 B2
(45) Date of Patent: Jul. 21, 2015

(54) FLOOD BARRIER

(71) Applicant: Agapito Ortiz, Mahwah, NJ (US)

(72) Inventor: Agapito Ortiz, Mahwah, NJ (US)

( * ) Notice: Subject to any disclaimer, the term of this patent is extended or adjusted under 35 U.S.C. 154(b) by 0 days.

(21) Appl. No.: 13/862,847

(22) Filed: Apr. 15, 2013

(65) Prior Publication Data

US 2013/0302092 A1 Nov. 14, 2013

Related U.S. Application Data

(60) Provisional application No. 61/644,741, filed on May 9, 2012.

(51) Int. Cl.

| | |
|---|---|
| ***E02B 7/00*** | (2006.01) |
| ***E02B 11/00*** | (2006.01) |
| ***E06B 9/00*** | (2006.01) |
| *E02B 3/10* | (2006.01) |

(52) U.S. Cl.

CPC ..... *E02B 7/005* (2013.01); *E02B 11/005* (2013.01); *E06B 9/00* (2013.01); *E02B 3/102* (2013.01); *E06B 2009/007* (2013.01)

(58) Field of Classification Search

USPC ..... 405/36, 80, 87, 92, 96, 97, 107, 115

See application file for complete search history.

(56) References Cited

U.S. PATENT DOCUMENTS

| | | | | |
|---|---|---|---|---|
| 2,277,286 | A | 3/1942 | Bechtner | |
| 3,436,887 | A | 4/1969 | Grossman | |
| 4,252,461 | A | 2/1981 | Colamussi et al. | |
| 4,333,726 | A | 6/1982 | Fuxelius | |
| 4,375,929 | A | 3/1983 | Clark | |
| 4,377,352 | A | 3/1983 | Goodstein et al. | |
| 4,458,456 | A | 7/1984 | Battle | |
| 6,216,399 | B1 * | 4/2001 | Belarbi | 52/169.14 |
| 6,726,405 | B1 | 4/2004 | Rorheim | |
| 7,364,385 | B1 | 4/2008 | Luke | |
| 7,735,291 | B2 | 6/2010 | Summy | |
| 7,762,742 | B1 | 7/2010 | Smith | |
| 7,972,081 | B2 | 7/2011 | Linares | |
| 8,500,365 | B1 * | 8/2013 | Vecherin et al. | 405/115 |
| 2004/0098937 | A1 | 5/2004 | Blake et al. | |
| 2010/0310315 | A1 | 12/2010 | James | |
| 2011/0268506 | A1 * | 11/2011 | Thornbury et al. | 405/118 |

FOREIGN PATENT DOCUMENTS

| | | | |
|---|---|---|---|
| FR | 2531475 | A1 | 2/1984 |
| GB | 2378726 | A | 2/2003 |
| GB | 2379948 | A | 3/2003 |
| GB | 2399375 | A | 11/2003 |
| GB | 2397086 | A | 7/2004 |
| GB | 2438701 | A | 5/2007 |
| GB | 2438856 | A | 12/2007 |
| SE | WO9718369 | A1 | 5/1997 |

* cited by examiner

*Primary Examiner* — Benjamin Fiorello
*Assistant Examiner* — Kyle Armstrong
(74) *Attorney, Agent, or Firm* — Gearhart Law LLC

(57) ABSTRACT

The current invention discloses a flood barrier having a first compartment and a second compartment, both compartments being preferably in an elongated shape from a side sectional view and being parallel in position. The flood barrier also includes a blocking membrane disposed in the second compartment, wherein a bottom end of the blocking membrane is attached to the bottom of the second compartment and a top end of the blocking membrane is attached to a floating member. The flood barrier may be positioned in the ground in front of a building, wherein when flood water approaches, the floating member may be kept afloat and pull the blocking membrane upward to block the invasion of flood water.

19 Claims, 4 Drawing Sheets

FLOOD BARRIER

CLAIM OF PRIORITY

This application claims priority from U.S. provisional application 61/644,741, filed on May 9, 2012, the contents of which are fully incorporated by reference.

FIELD OF THE INVENTION

The invention relates to a flood barrier and more particularly relates to a flood barrier using a floating device and blocking membranes to automatically adjust the height of the flood barrier and achieve effective prevention of water invasion.

BACKGROUND OF THE INVENTION

In many areas, homes and businesses are susceptible to flooding. Flood water from rain or other natural or unnatural events can rise at very fast speeds, usually from the ground level, and cause serious damages to the exterior and interior of a building. This is a global problem because flooding occurs in many countries and regions all across the world. The damages are widespread and severe, with lasting consequences. According to the National Weather Services, flooding caused more than five billion dollars of damages in 2010 in the United States. The problem of flooding is real and significant, justifying comprehensive and extensive solutions, at least part of which requires protection of buildings from flood damages.

When flood water rises, it usually accumulates outside building structures such as residential homes and business setups. In many instances, the water flows or leaks into the interior of the building. Even if the flood water is temporarily kept out, it may still cause significant damages to the exterior wall and the foundation of the building, making the structure unstable and resulting in reduction of property values. It would be desirable to have a system to keep the flood water away from the building and reduce the damages. To assure widespread usage, it is also important to have a protection mechanism that is effective, easy to install, and inexpensive.

Some devices and systems have been developed to prevent flood water from serious invasion of a building. These designs, however, show shortcomings in one aspect or another. For example, U.S. Pat. No. 4,458,456 discloses an apparatus for protecting structures from flood waters having a channel surrounding the structure to be protected, the channel having at least in part a bottom and side walls with reinforcement means therewithin or attaching a collapsible water-impermeable sheeting which, when not in use would be stored within the channel, and when in use would be raised to an erected position around the entirety of the structure. The sheeting would be sealably anchored within the channel on its lower edge by concrete, and therefore would prevent water from coming into contact with the structure. The apparatus would also have the means for allowing air to communicate between the exterior and the interior structure and a means for covering the channel to protect the sheeting while the sheeting is stored within the channel.

This design, however, has one significant disadvantage—the requirement that the protecting sheet needs to be erected when there is a possibility of flooding. Such a design is inconvenient, unreliable and unsafe. Erecting a barrier outside a building, which in some cases can be vast, may be a time consuming and energy depleting job. Without special tools, it is very inconvenient, or even impossible, for a person to do. In addition, it is possible that the person taking care of the building is not at the site when the sign that flood is to occur becomes obvious. This is especially true for business sites. The design disclosed in U.S. Pat. No. 4,458,456 and similar inventions do not address such concerns. Moreover, it is dangerous for a person to try to erect barriers, most likely in pouring rain, when flooding is about to occur.

There are also designs using mechanisms that do not require special attention before flooding. For example, GB 2,397,086 discloses a flood protection system including a floatation body securely affixed to a flexible, waterproof barrier and guide rollers running in guide rails affixed to the property to be protected. The other end of the flexible waterproof barrier is affixed in a secure and waterproof manner to the bottom of the container for the flexible waterproof barrier when at rest. The barrier container is sunk into the ground immediately adjacent to the boundary of the property to be protected.

This design, however, does not address the issue that rain water may fall to the space between the floatation body and the house. Since the water is falling exclusively from a higher position into and beside the container, it is very likely that the floatation body and the waterproof barrier would have water on both sides, negating the result to protect the building from water invasion and soaking.

The current invention, however, addresses all the concerns in protecting a building from flooding and the disadvantages inherent in the related arts. Various implements are known in the art, but fail to address all of the problems solved by the invention described herein. Two embodiments of this invention are illustrated in the accompanying drawings and will be described in more detail herein below.

SUMMARY OF THE INVENTION

The present invention discloses a flood barrier, comprising a first compartment and a second compartment, both compartments being preferably in an elongated shape from a sectional view and being parallel in position. The first compartment has a front wall, a first bottom wall, a first top opening, and a separation wall. Similarly, the second compartment has a back wall, a second bottom wall, and a second top opening, the second compartment being positioned generally parallel to the first compartment and sharing the separation wall with the first compartment. The flood barrier of the current invention further comprises a blocking membrane having a top end and a bottom end, the blocking membrane being disposed in the second compartment and the bottom end of the blocking membrane being attached to the second bottom wall and/or the back wall of the second compartment. Moreover, the flood barrier further comprises a floating member being disposed in the second compartment and a connecting hook affixing the top end of the blocking membrane to the floating member. In addition, there are seeping holes on the separation wall connecting the first compartment to the second compartment, wherein the blocking membrane is impermeable to liquid; the floating member can float in water and pull the top end of the blocking membrane to and out of the second top opening. The blocking membrane may be a one-layered or a multi-layered structure. The preferred blocking membrane may comprise a first layer and a second layer of blocking structures, which are generally similar in terms of positioning, attachment, and functionality.

The flood barrier may be positioned in the ground in front of the property to be protected. The property may be a residential dwelling, a business establishment, a military setup, or any building or structure that needs flood protection. The building preferably has an exterior wall, outside which the flood barrier may be disposed. The flood barrier is preferably close or right adjacent to the exterior wall. The second compartment is preferably positioned closer to the exterior wall, while the first compartment is preferably closer to the direction where flood water is likely to come from. The first opening and second opening of the two compartments may not be entirely blocked, allowing flood water to get into the first compartment and the floating member to rise out of the second compartment. Preferably, the front wall and the separation wall have their top ends slightly higher than the ground level, preventing unwanted accumulation of water in the first compartment and the second compartment. The top of the back wall is preferably higher than the front wall and the separation wall, allowing the back wall to protrude out of the ground level. The protruding part of the back wall is preferably positioned right next to the exterior wall of the building, preventing accumulation of water between the exterior wall and the flood barrier.

When there is no flooding, the blocking membrane and the floating member are kept in the second compartment. The blocking membrane is coiled so that it may be properly accommodated. Flood water is more likely to enter the first compartment before flowing into the second compartment. The water that flows into the first compartment may circulate into the second compartment through the holes on the separation wall. In such a manner, the second compartment is filled from its bottom. Such a feature is important because filling from top may cause the accumulation of water between the membrane and the exterior wall of the building, reducing the effectiveness of the flood barrier. When flood water keeps rising, the floating member exits the second compartment and pulls the blocking membrane out of the second compartment, forming a barrier to blocking the invasion of flood water.

The blocking membrane is made of materials impermeable to liquid, i.e. water. The membrane is preferably flexible and robust. With such a design, the membrane is strong to withstand the pressure from the flood water without rupturing. More importantly, the membrane may be pressed against the back wall and the exterior wall of the building when flood water rises, preventing the flood water from entering the space between the flood barrier and the exterior wall.

The walls of the flood barrier are preferably made from durable and strong material that is resistant to erosion. It is also desirable that the walls for the food barrier are made from inexpensive materials. Moreover, the walls may be made from the same or different materials, having different designs to fit varying needs.

Another concern is the roof drain pipes that may fill the flood barrier if not properly designed. Since the flood barrier is preferably installed close to the exterior wall of the building, if the drain pipes are directed to the top openings of the flood barrier, the floating member may be pushed away from the exterior wall of the building by the water from the pipes and allow water to get into the space between the flood barrier and the exterior wall. Therefore, it is preferable to have the outlets of the drain pipes positioned farther from the exterior wall than the openings of the flood barrier, preventing unnecessary reduction of the flood barrier's effectiveness.

In general, the present invention succeeds in conferring the following, and others not mentioned, desirable and useful benefits and objectives.

It is an object of the present invention to provide a flood barrier that is safe and easy to use.

It is another object of the present invention to provide a flood barrier having a first compartment and a second compartment in general parallel position.

It is another object of the present invention to provide a flood barrier that can automatically deploy the blocking mechanisms.

It is another object of the present invention to provide a flood barrier having a floating member that ensures times adjustment of the barrier's height.

Yet another object of the present invention is to provide a flood barrier that does not require manual erecting of the blocking mechanisms.

Yet another object of the present invention is to provide a flood barrier that requires a minimum of maintenance.

Still another object of the present invention is to provide a flood barrier that employs a mechanism to initiate the floatation of the floating member from the bottom.

It is another object of the present invention to provide a flood barrier that is robust and durable.

Yet another object of the present invention is to provide a flood barrier that effectively blocks water invasion and leakage.

Still another object of the present invention is to provide a flood barrier that is inexpensive.

Yet another object of the present invention is to provide a flood barrier that uses a double-membrane design to block water invasion and leakage.

Still another object of the present invention is to provide flood barriers having different sizes and dimensions to fit the needs for different buildings and flooding conditions.

It is a further object of the invention to provide a flood barrier that is easy to manufacture.

DESCRIPTION OF THE PREFERRED EMBODIMENTS

Figure 1B:
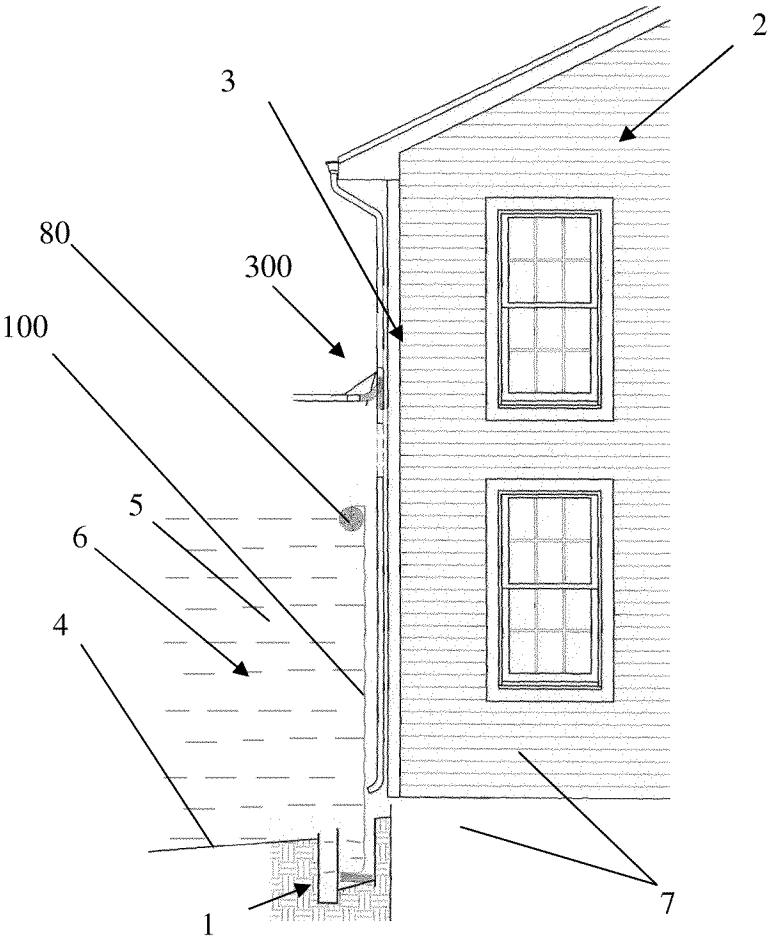
FIG. 1A and FIG. 1B show a side sectional view of a preferred embodiment of the flood barrier when it is installed in the ground adjacent to a building before and after flooding occurs.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Figure 1A:
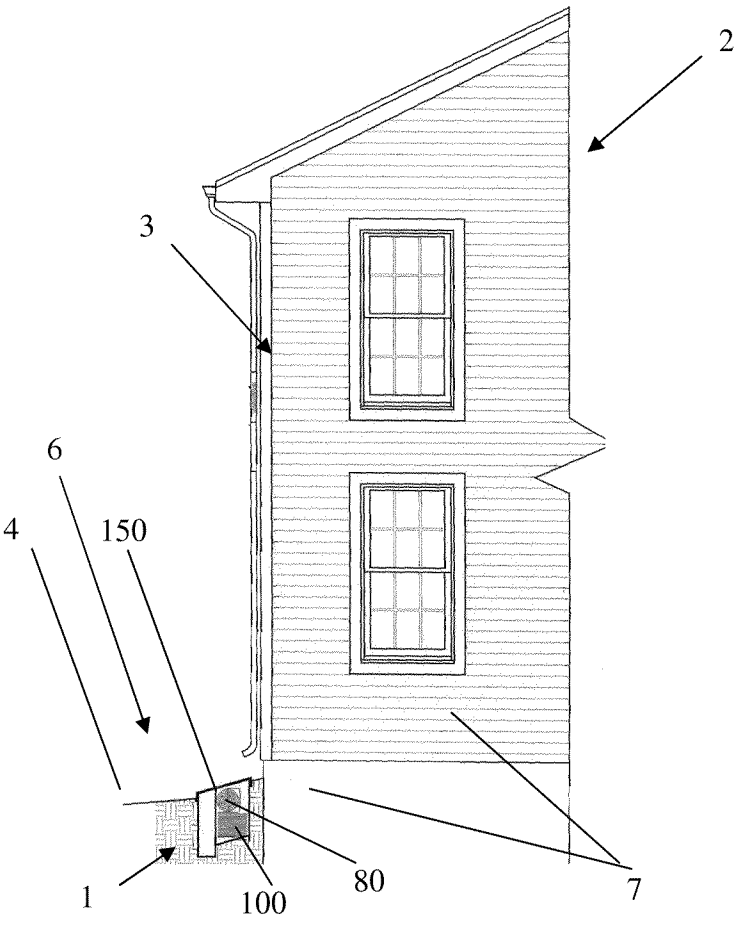

FIGS. 1A and 1B show a side sectional view of a first preferred embodiment of the flood barrier when it is installed in the ground adjacent to a building before and after flooding occurs. Shown in FIG. 1A is a building 2 having an exterior wall 3, a flood barrier 1 inserted into the ground adjacent to the exterior wall 3, the flood barrier 1 having a floating member 80, a blocking membrane 100, and a cover 150. Also shown in FIG. 1A are the ground level 4, the flood invasion area 6, and the interior 7 of the building 2. Similarly, FIG. 1B shows the building 2 having an exterior wall 3, a flood barrier 1 inserted into the ground adjacent to the exterior wall 3, the flood barrier having a floating member 80 and a blocking membrane 100. Also shown in FIG. 1B are the ground level 4, the rising flood water 5, the flood invasion area 6, the interior 7 of the building 2, and an adjustable pipe system 300.

Figure 2:
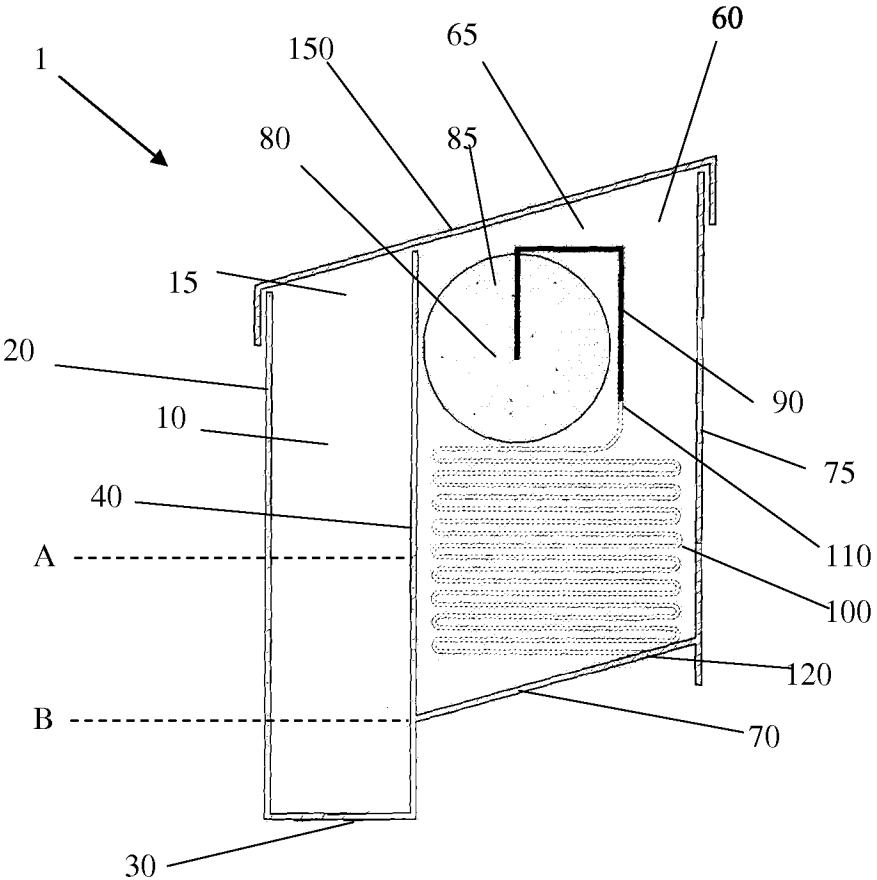
FIG. 2 shows a detailed side sectional view of a preferred embodiment of the flood barrier.

FIGS. 1A and 1B are illustrative of the basic usage of the flood barrier 1. The detailed structure of the flood barrier 1 is depicted in FIG. 2. In general, while FIG. 1A illustrates the scene before the flood water invasion area 6 is flooded, FIG. 1B illustrates the scene after the same area is flooded and the flood water 5 has been blocked by the flood barrier 1. FIGS. 1A and 1B demonstrate how the flood barrier 1 works: before the influx of flood water 5, the blocking membrane 100 is coiled and the floating member 80 stays in the flood barrier 1, which is covered by cover 150; after the rise of the flood water 5, the flood member 80 is kept afloat and the blocking membrane 100 is pulled upwards to block the flood water 5 from contacting the exterior wall 3 of the building 2. The floating member 80 and the blocking membrane 100 protect the building 2, especially its interior 7, from the invasion of the flood water 5. In addition, in FIG. 1B, the adjustable pipe system 300 is put to use and the pipe outlet is pointing away from the top of the flood barrier 1, preventing unwanted flow of water into the space between the blocking membrane 100 and the exterior wall 3.

FIG. 2 shows a detailed side sectional view of a preferred embodiment of the flood barrier. Shown in FIG. 2 is the flood barrier 1 comprising a first compartment 10 having a front wall 20, a first bottom wall 30, a first top opening 15, and a separation wall 40; a cover 150; a second compartment 60 having a back wall 75, a second bottom wall 70, and a second top opening 65, the second compartment 60 being positioned generally parallel to the first compartment 10 and sharing the separation wall 40; a blocking membrane 100 having a top end 110 and a bottom end 120, the blocking membrane 100 being disposed in the second compartment 60 and the bottom end 120 of the blocking membrane 100 being attached to the second bottom wall 70 and/or the back wall 75; a floating member 80; the cover 150 covering the first top opening 15 and the second top opening 65; and a connecting hook 90 affixing the top end 110 of the blocking membrane 100 to the floating member 80.

Preferably, from a side sectional view, the first compartment 10 and the second compartment 60 are positioned largely in parallel. In such a manner, the front wall 20, the separation wall 40, and the back wall 75 are generally parallel to one another. Alternatively, the first compartment 10 and the second compartment 60 may be other shapes and the front wall 20, the separation wall 40, and the back wall 75 are not parallel. For example, the second compartment may be an oval shape from a side sectional view. In addition, there is no requirement that the first wall 20, the first bottom wall 30, and the separation wall 40 are visually distinct structures. Similarly, there is no requirement that the separation wall 40, the second bottom wall 70, and the back wall 75 are visually distinct structures. As long as these walls form two compartments side by side, the exact structure and boundaries of the walls may vary.

Upon installation, the flood barrier 1 is inserted in the ground adjacent to an exterior wall 3 of a building 2, as shown in FIG. 1. The back wall 75 of the second compartment 60 is preferably positioned parallel to and abuts the exterior wall 3. The area away from the exterior wall 3 is defined as the flood invasion area 6, wherein the flood barrier 1 is positioned between the exterior wall 3 and the flood invasion area 6. The first top opening 15 and the second top opening 65 are generally exposed and it is preferable that the front wall 20, the separation wall 40, and the back wall 75 are partially exposed. In general, when the flood barrier 1 is placed in the ground, the first bottom wall 30 and the second bottom wall 70 are positioned below the first opening 15 and second opening 65 are on top. As used here to term the various components of the flood barrier 1, "top" is generally the direction opposite to earth gravity, while "bottom" is generally the direction same as earth gravity.

In terms of dimension, the size of the flood barrier 1 may vary according to the building to be protected and the flood condition to be confronted. The first compartment 10 and second compartment 60 may be generally close in depth and the depth may vary from 10 to 150 cm, with the preferred depth to be around 50 cm. It is preferable that the first compartment 10 is minimally deeper than the second compartment 60, with the difference of about 5 cm. The widths of the first compartment and the second compartment—defined as the distance between the front wall 20 and the separation wall 40 and the distance between the separation wall 40 and the back wall 75—may have a range of 1 to 100 cm, with the preferred width for the first compartment 10 to be around 15 cm and the preferred width for the second compartment 60 to be around 30 cm. Preferably, the top of the front wall 20, the top of the separation wall 40, and the top of the back wall 75 are at a similar level, with the top of the separation wall 40 being slightly higher than the top of the front wall 2 and the top of the back wall 75 being slightly higher than the top of the separation wall 40. Such as design, as shown in FIG. 2, allows the first top opening 15 and the second top opening 65 to be conveniently covered. Alternatively, the top of the back wall 75 may be significantly higher than the top of the separation wall 40, i.e. the top of the back wall 75 being approximately 30 cm higher. Such a design provides maximal protection in terms of flood blockade. Since the flood barrier 1 is placed right adjacent to the exterior wall 3 of the building 2, the taller back wall 75 ensures that the back wall protrudes out of the ground and abuts the exterior wall 3, providing backup defense against flood invasion behind the blocking membrane 80. A design with a significantly higher back wall 75, however, may require an additional structure to accommodate the covering.

In terms of materials, the front wall 20, the first bottom wall 30, the separation wall 40, the second bottom wall 70, and the back wall 75 may be made from same or different materials. The material is preferred to be safe, strong, and impermeable to liquid. Moreover, it would be desirable that the material is inexpensive and easy to manufacture. The materials that may be used include but are not limited to: metal, rubber, and plastic such as, but not limited to, polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or paperboard coated with a suitable waterproof coating such as, but not limited to, polyethylene, or some combination thereof. The preferred material for the walls is PVC. The floating member 80 may be made from floating materials such as but not limited to foam, wood, low-density plastic such as low-density polyethylene (LDPE). The preferred material for the floating member 80 is foam such as compressed styrofoam. The floating member 80 may be a hollow and sealed chamber made from any material, allowing the floating member 80 to provide sufficient buoyancy force. The connecting hook 90 may be made from materials including but not limited to metal, rubber, and plastic such as, but not limited to, polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or paperboard coated with a suitable waterproof coating such as, but not limited to, polyethylene, or some combination thereof. The connecting hook 90 is preferably made from rigid material. The preferred material for the connecting hook 90 is PVC. The floating membrane 100 is made from material that is preferably strong, light, flexible, and impermeable to water. The materials suitable to make the floating membrane 100 include but are not limited to rubber sheets, metal foils, and plastic sheets such as, but not limited to, polyethylene terephthalate (PET), polyethylene (PE), polyvinylidene chloride (PVDC), low-density polyethylene (LDPE), polypropylene (PP), polystyrene (PS), high impact polystyrene (HIPS) and polycarbonate (PC), or paper or fabric coated with a suitable waterproof coating such as, but not limited to, polyethylene, or some combination thereof. The preferred material for the floating membrane 100 is rubber.

Although the floating member has a round shape from a side sectional view, it does not have to use that shape. For example, the side sectional view of the floating member 80 may be square, rectangular, or a honeycomb shape. Moreover, in general, the floating member is preferably a rod or bar that has a particular side sectional view. However, the floating member 80 may also be a series of floating units.

The blocking membrane 100 may be a one-layered or a multi-layered structure. In FIG. 2, the blocking membrane comprises two layers of blocking structures, which are generally similar in terms of positioning, attachment, and functionality. Such a two-layered design is beneficial in terms of strength and durability of the blocking membrane 100. However, more layers may suggest heavier in weight and more difficult to be pulled up by the floating member 80. Therefore, the exact structure of the blocking membrane 100 may vary according to the materials used and the dimension of the floating member 80.

In FIG. 2, a top part 85 of the floating member 80 is also shown. Preferably, the connecting hook 90 is connected to the top part 85 of the floating member 80. The connecting hook 90, as shown in FIG. 2, has an overall hook-structure with straight segments. This shape is not a firm requirement. As long as the connecting hook 90 effectively affixes the top end 110 to the floating member, the side sectional view of the connecting hook 90 may be any shape. It is preferable, however, that the connecting hook form a blocking sheet structure and be made of materials impermeable to liquid. Such a design enhances the flood blocking capacity of the flood barrier 1. Since the connecting hook 90 is directly connected to the top part 85 of the floating member 80, the blocking sheet formed by the connecting hook 90 may serve to prevent flood water invasion, together with the blocking membrane 100. Such a design ensures that the blocking structures, the combination of the connecting hook 90 and blocking membrane 100, extend over the top of the floating member 80, allowing for enhanced blockade.

In addition to the structures shown in FIG. 2, the flood barrier 1 may further comprises a cover 150 that shields the first top opening 15 and the second top opening 65. The cover 150 is not an indispensible part of the flood barrier 1, but having such a structure may prevent unwanted access to the flood barrier and reducing the likelihood of injuries. The cover 150 is preferably removable and openable, allowing easy adjustment before flooding is likely to occur, if needed. A preferred design is to allow the cover 150 to be pushed open by the floating member 80 from underneath when water has entered the second compartment. The cover 150 may also have holes or gaps that allow flood water to enter the first compartment 10 and/or the second compartment 60 so to eliminate the need to fully remove the cover before flooding.

Figure 3:
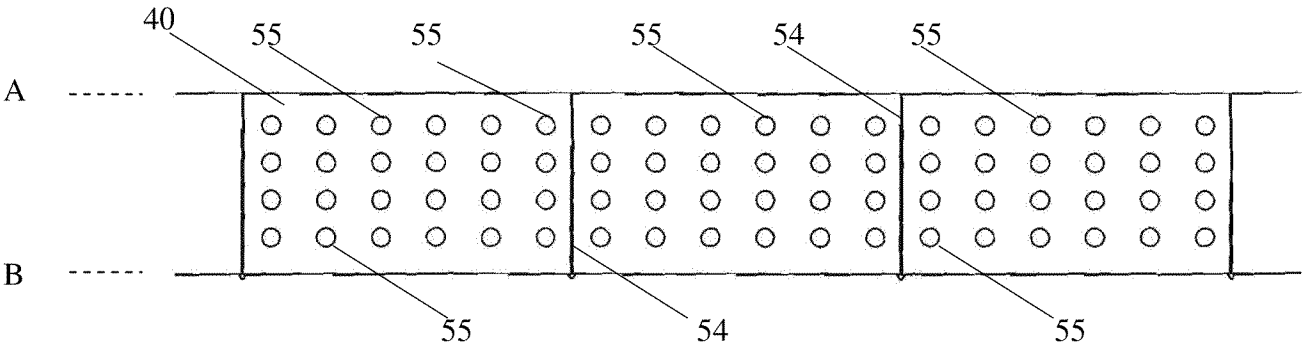
FIG. 3 shows a front sectional view of a preferred embodiment of a flood barrier when more than one barrier is attached together.

FIG. 3 shows a front sectional view of a preferred embodiment of a flood barrier when more than one barrier is attached together. Shown here is the portion of the separation wall 40 between points A and B shown in FIG. 2. The perspective is from the front wall 20 looking to the separation wall 40. Shown in FIG. 3 are the separation wall 40, the seeping holes 55 through separation wall 40 and the integrating junctures 54. For clarity purposes, not all the seeping holes 55 or the integrating junctures 54 are marked.

As a whole, the flood barrier 1 may be made by any method necessary to form an integrated blockade. Preferably, the flood barrier 1 may be made from units, each one of which may have the side sectional view as shown in FIG. 2. The units may be joined together by approaches such as but not limited to welding, rivets, screws, gluing, molding, or any combination thereof. Or additional connecting structures may be employed to integrate the units together. There is no requirement, however, that all the units are the same. For example, the units covering the corners of the building may take an angled shape that is complementary to the angle of the corners. As long as the side sectional view is similar to what is shown in FIG. 2, such designs are in the purview of the current invention. As shown in FIG. 3, joining the units may be shown as integrating junctures 54. Such integrating junctures may exist not only on the separation wall 40, but also on other components such as the front wall 20, the back wall 75, the first bottom wall 30, and the second bottom wall 70. Similarly, the floating member 80 and the blocking membrane 90 may be made from a whole piece or from many integrated units. As long as the junctions of the units are effective to ensure liquid impermeability, the design may be altered.

The seeping holes 55 are important to the current invention. It is preferable to have a plurality of holes through the separation wall 40 and connecting the first compartment 10 and second compartment 60. When properly positioned, the first compartment 10 is closer to the flood water invasion area 6, as shown in FIG. 1, flood water 5 enters the first compartment 10 first. Through the seeping holes 55, the flood water 5 enters the second compartment 60 and provides buoyancy power to the floating member 80 from the bottom. Although a plurality of holes are preferred, there is no firm requirement that more than one hole is needed. Moreover, it is key to at least have some seeping holes 55 in the lower sections of the separation wall 40. Preferably, the seeping holes 55 are evenly distributed through the separation wall 40.

FIGS. 4A-D show a side view of a specially designed adjustable drainage system 300 serving as supplementary structures for the flood barrier. With a regular drainage, it is possible that the outlet of the drainage is right above the flood barrier 1. The water from such a regular drainage may flow into the space between the blocking structures, including the floating member 80, the connecting hook 90, and the first and/or second blocking membranes, and the exterior wall 3 or the building, negating the effects of the flood barrier. The structures disclosed by FIG. 4 address such a problem. If installed, such structures may be considered part of the flood barrier system.

Figures 4A, 4B, 4C, 4D:
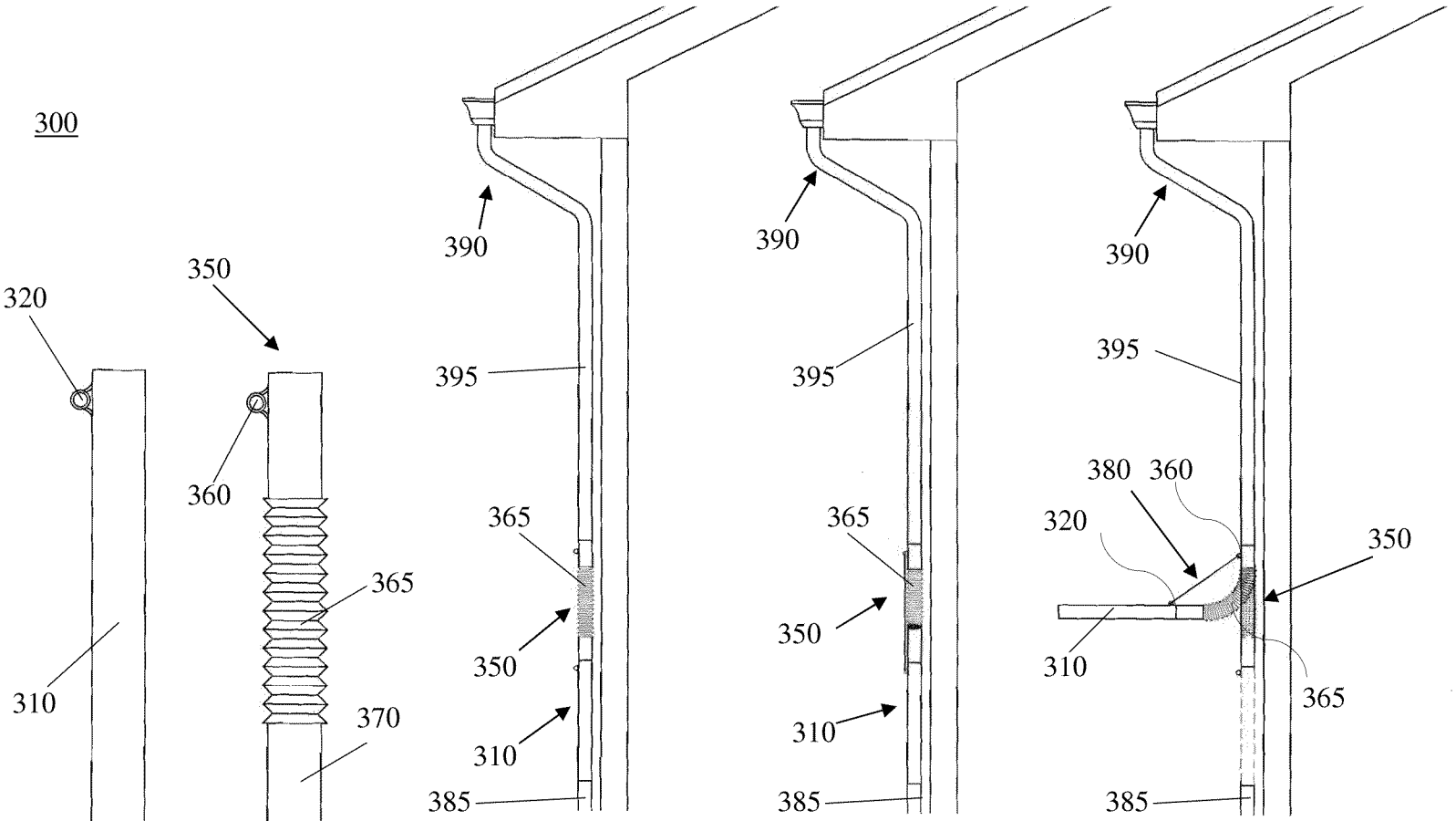
FIG. 4A-D show a side view of a specially designed drainage system serving as supplementary structures for the flood barrier.

Shown in FIG. 4A is part of the specially designed adjustable drainage system 300 comprising an extension pipe 310 having a first orifice 320 and an flexible pipe 350 having a second orifice 360, a flexible section 365, and an flexible pipe insert 370. Shown in FIG. 4B is a modified version of a regular drainage pipe including a curved pipe 390 and a top vertical pipe 395, the top vertical pipe 395 is inserted into the flexible pipe 350, wherein the flexible pipe insert 370 of the flexible pipe 350 is inserted into the extension pipe 310, which is inserted into a bottom vertical pipe 385. Shown in FIG. 4C is the modified regular drainage pipe in a detached position, with exactly the same components as FIG. 4B, except that the flexible section 365 of the flexible pipe 350 is compressed and the extension pipe 310 is no longer inserted into the bottom vertical pipe 385. Shown in FIG. 4D is the completely adjusted drainage system including the curved pipe 390, the extension pipe 310 having a first orifice 320 and an flexible pipe 350 having a second orifice 360, a flexible section 365, and an flexible pipe insert 370, wherein the first orifice 320 and the second orifice 360 are linked by a connecting cord 380, tilting the outlet of the extension pipe outward.

As shown in FIGS. 4A-D, the adjustable regular drainage pipes 300 may be used for regular needs when it is no threat of flooding. According to FIGS. 4A and 4D, the flexible pipe 350 may be compressed to allow the extension pipe 310 to be pulled away from the bottom vertical pipe 385. The direction of water flow may be controlled by twisting the flexible section 365 of the flexible pipe 350. The extension pipe 310 may be tilted and pointed away by using a connecting cord 380 that links the first orifice 320 with the second orifice 360.

When it is likely to rain, the person in care of the property may simply detach the extension pipe 310 from the bottom vertical pipe 385 and then use the connecting cord 380 to ensure that the outlet of the extension pipe 310 does not point directly to the flood barrier 1. Such a design ensures that the water from the roof flows out and keeps a distance from the exterior wall, preventing negative effects on the function of the flood barrier 1.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A flood barrier, comprising:

a first compartment having a front wall, a first bottom wall, a first top opening, and a separation wall;

a second compartment having a back wall, a second bottom wall, and a second top opening, the second compartment being positioned generally parallel to the first compartment and sharing the separation wall;

a blocking membrane having a top end and a bottom end, the blocking membrane being disposed in the second compartment and the bottom end of the blocking membrane being attached to the second bottom wall and/or the back wall;

a floating member; and a connecting hook affixing the top end of the blocking membrane to the floating member, wherein the blocking membrane is impermeable to liquid, there is at least one seeping hole positioned through the separation wall and connecting the first compartment and the second compartment, and the floating member is capable of floating in water and pulling the top end of the blocking membrane to and out of the second top opening.

2. The flood barrier of claim 1, wherein the first compartment and the second compartment are of an elongated shape from a side sectional view.

3. The flood barrier of claim 2, wherein the front wall, the separation wall, and the back wall are generally parallel.

4. The flood barrier of claim 1, wherein the flood barrier is inserted in a ground adjacent to an exterior wall of a building, the back wall of the flood barrier being positioned parallel to the exterior wall of the building, and the first top opening and the second top opening of the flood barrier are exposed above the ground.

5. The flood barrier of claim 1, wherein there are a plurality of seeping holes positioned through the separation wall to connect the first compartment and the second compartment.

6. The flood barrier of claim 1, wherein the floating member has a top part being closer to the second top opening, the connecting hook attaching to the top part of the floating member.

7. The flood barrier of claim 6, wherein the connecting hook forms a blocking sheet that is impermeable to liquid.

8. The flood barrier of claim 1, wherein there are a plurality of seeping holes positioned through the separation wall, the seeping holds evenly distributed in the separation wall.

9. The flood barrier of claim 1, wherein the front wall, the separation wall, the first bottom wall, the second bottom wall, and the back wall, are made of PVC.

10. The flood barrier of claim 1, wherein the floating member is made of foam.

11. The flood barrier of claim 1, wherein the blocking membrane is made of rubber.

12. The flood barrier of claim 1, wherein the blocking membrane is two-layered structure.

13. The flood barrier of claim 1, further comprising a cover covering the first top opening and the second top opening.

14. The flood barrier of claim 1, further comprising a drainage system comprising a curved pipe, a top vertical pipe, a bottom vertical pipe an extension pipe having a first orifice, and a flexible pipe having a second orifice, a flexible section, and an flexible pipe insert, wherein the curved pipe is connected to the top vertical pipe, the top vertical pipe is connected to the flexible pipe, the flexible pipe is connected to the extension pipe, and the extension pipe is connected to the bottom vertical pipe, the flexible section is compressible to allow disconnection of the extension pipe with the bottom vertical pipe, and first orifice and the second orifice are linked by a connecting cord.

15. The flood barrier of claim 14, wherein the extension pipe points to a direction, the connecting cord has a length, and when the extension pipe is connected to the flexible pipe, the direction of the extension pipe is capable of being controlled by twisting the flexible section of the flexible pipe and adjusting the length of the connecting cord.

16. A flood barrier, comprising:

a first compartment having a front wall, a first bottom wall, a first top 5 opening, and a separation wall;

a second compartment having a back wall, a second bottom wall, and a second top opening, the second compartment being positioned generally parallel to the first compartment and sharing the separation wall;

a blocking membrane having a top end and a bottom end, the blocking membrane being disposed in the second compartment and the bottom end of the blocking membrane being attached to the second bottom wall or the back wall;

a floating member having a top part; and a connecting hook affixing the top end of the blocking membrane and the second top end of the second blocking membrane to the top part of the floating member, wherein the blocking membrane comprises of two layers that are impermeable to liquid, the first compartment and the second compartment are of an elongated shape from a side sectional view, the front wall, the separation wall, and the back wall are generally parallel, the floating member is capable of floating in water and pulling the blocking membrane and the second blocking membrane to and out of the second top opening, and there are a plurality of seeping holes through the separation wall, connecting the first compartment to the second compartment.

17. The flood barrier of claim 16, wherein the flood barrier is inserted in a ground adjacent to an exterior wall of a building, the back wall of the flood barrier being positioned parallel to the exterior wall and the first top opening and the second top opening of the flood barrier are exposed above the ground.

18. The flood barrier of claim 17, wherein the front wall, the separation wall, the first bottom wall, the second bottom wall, and the back wall, are made of PVC, the floating member is made of foam, and the first membrane is made of rubber.

19. The flood barrier of claim 18, wherein a distance between the front wall and the separation wall is around 15 cm and a distance between the separation wall and the back wall is around 30 cm.

* * * * *